US009937412B2

(12) United States Patent
Hendon

(10) Patent No.: US 9,937,412 B2
(45) Date of Patent: Apr. 10, 2018

(54) FAST MONEY BINGO

(71) Applicant: Rickey R. Hendon, Chicago, IL (US)

(72) Inventor: Rickey R. Hendon, Chicago, IL (US)

( * ) Notice: Subject to any disclaimer, the term of this patent is extended or adjusted under 35 U.S.C. 154(b) by 217 days.

(21) Appl. No.: 15/154,206

(22) Filed: May 13, 2016

(65) Prior Publication Data

US 2017/0326441 A1 Nov. 16, 2017

(51) Int. Cl.
*A63F 3/06* (2006.01)
*G06F 17/00* (2006.01)

(52) U.S. Cl.
CPC ..... *A63F 3/062* (2013.01); *A63F 3/0645* (2013.01)

(58) Field of Classification Search
USPC ..... 273/142 F, 269, 292
See application file for complete search history.

(56) References Cited

U.S. PATENT DOCUMENTS 5,755,619 A * 5/1998 Matsumoto ..... A63F 3/062 273/269
7,905,777 B2 * 3/2011 Muir ..... G07F 17/3255 463/25
2009/0075714 A1 * 3/2009 Meyer ..... G07F 17/32 463/19
2010/0283204 A1 * 11/2010 Mahon ..... A63F 1/18 273/292
2013/0285325 A1 * 10/2013 Thomassian ..... A63F 3/0645 273/269
2014/0080567 A1 * 3/2014 Khal ..... G07F 17/329 463/19
2014/0113701 A1 * 4/2014 Weiss ..... G07F 17/3218 463/20
2014/0274278 A1 * 9/2014 Elias ..... A63F 3/0645 463/19
2014/0274280 A1 * 9/2014 Macbeth ..... G07F 17/329 463/19
2015/0011289 A1 * 1/2015 Colvin ..... G07F 17/3244 463/19

* cited by examiner

*Primary Examiner* — Nini Legesse
(74) *Attorney, Agent, or Firm* — Fraline J. Allgaier

(57) ABSTRACT

An improved bingo method and apparatus with a plurality of bingo balls numbered from 1 to 40. The plurality of bonus balls has various bonus values and each player has the capacity to place an individualized wager against a wagering establishment. A caller announces the start of the game and the value of a plurality of bonus balls, calls the bingo balls and bonus balls drawn from a random ball generator and announces the outcome of the game after a maximum of 21 spins of the random ball generator. Additional features include the possibility of a peer-to-peer wagering system where each player places identical wagers, plays against the set pool of entry fees and the house retains a percentage of the pot. The game further features a convenient table arrangement that can be played on the main floor of a wagering establishment or a large wagering room.

30 Claims, 8 Drawing Sheets

10
12
14
16
18
26
38
24
54
62
62
10
58
66
Game 1
Game 2
Game 3
Game 4
Game 5
Game 6
Game 7
Game 8
Game 9
Game 10
Called
Gold
1. Gold
2. B7
3. B1
4. B15
5. G47
6. G44
7. O33
8. O1
9. B1
10. B16
11. N24
12. N15
13. N21
14. I8
15. I
16. B34
17. G39
18. G55
19. O13
20. O
21. N2
22. N3
23. N4
24. N5
25. N6
26. N7
27. N8
28. N9
29. N10
30. N11
31. N12
32. N13
33. N14
34. N15
35. N16
36. N17
37. N18
38. N19
39. N20
40. N21
Game Begin
Wager
Wager
Wager

FIG. 3

| B (42) | I (44) | N (46) | G (48) | O (52) |
|---|---|---|---|---|
| 1-9 | 9-16 | 17-24 | 25-32 | 33-40 |
| 7 | 16 | Free Space (56) | 32 | 39 |
| 4 | 9 | 24 | 25 | 40 |
| 2 | Free Space | 18 | 28 | 37 |
| 6 | 11 | 15 | 29 | 36 |
| 1 | 13 | 17 | Free Space | 33 |

24

38

54

FIG. 4

| B | I | N | G | O |
|---|---|---|---|---|
| 4 | 16 | 32 | 46 | 64 |
| 5 | 22 | 37 | 50 | 66 |
| 10 | 23 | FREE | 55 | 66 |
| 11 | 24 | 40 | 56 | 70 |
| 14 | 30 | 43 | 57 | 74 |

25

FIG. 5

| Bonus Ball | Name | Call Effect |
|---|---|---|
| $ 34 | Big Money Ball | Combines the value of previously called bonus balls |
| 2x 36 | Double Bet Multiplier | Doubles the bet |
| 3x 36 | Triple Bet Multiplier | Triples the bet |
| 64 28 | Eliminator Ball | Cancels all bonus balls called before or after |
| Gold 32 | Gold Ball | Super mutiplier |

FIG. 6

| Wager | Call |
|---|---|
| Ante Wager | Minimum Wager for 21 calls |
| Bonus Wager | Gold Ball is Called |
| Bonus Wager | Big Money Ball is Called |
| Super Bonus Wager | First Ball Called is a Gold Ball |
| Super Bonus Wager | First Ball Called is a Big Money Ball |

FIG. 7

| BONUS PAYOUTS | |
|---|---|
| SPIN | PAYOUT |
| Gold Ball on First Spin | Pays 40-1 |
| Gold Ball and Money Ball First Two Spins | Pays 100-1 |
| Gold Ball and Bonus Ball First Two Spins | Pays 20-1 |
| Money Ball and Bonus Ball First Two Spins | Pays 20-1 |
| Gold Ball, Money Ball and Bonus Ball First Three Spins | Pays 1000-1 |
| | |

FIG. 8

| BINGO BONUS PAYOUTS WITHIN 21 SPINS | |
|---|---|
| BINGO | PAYOUT |
| Bingo With Gold Ball and Money Ball | Pays 10-1 |
| Bingo With Gold Ball or Money Ball | Pays 5-1 |
| Bingo With Gold Ball, Money Ball and One Bonus Ball | Pays 20-1 |
| Bingo With Gold Ball, Money Ball and Two Bonus Balls | Pays 100-1 |
| Bingo With Gold Ball, Money Ball and Three Bonus Balls | Pays 1000-1 |
| Bingo With One Bonus Ball | Pays 2-1 |
| Bingo With Two Bonus Balls | Pays 3-1 |
| Bingo With Three Bonus Balls | Pays 100-1 |
| Eliminator Ball Cancels Out All Bonus Balls | |

FAST MONEY BINGO

BACKGROUND OF THE INVENTION

The present invention relates to an improved bingo method and apparatus that improves a player's odds of winning by means of a bonus wagering system against the house. The improved bingo method and apparatus as described herein has an improved bonus wagering and bonus elimination system allowing for individual wagers against the house, reduces the number of people needed to play the game, does not require a large wagering establishment and increases the speed of the game by requiring a maximum of 21 spins with or without a winner. The game also allows for peer-to-peer wagering against a set pool of entry fees. This creates a communal effect among the players who can wager equal amounts against one another and not against the wagering facility. The maximum of 21 spins would not apply and the players in the peer-to-peer wagering system would continue to play until a winner is announced. The casino would then receive a percentage of the winner's pot.

The improved bingo method and apparatus provides new ways for the player to wager and interact using a custom wagering pool that is controlled by the players. Additional players are easily invited to join new games. This further provides for a social and exciting competition among friends or large groups of players. The game and excitement can be brought to the main floor of a wagering establishment or a large wagering room and played at a standard wagering table having the capacity to seat 7 to 10 players. There is added excitement because of the eliminator ball which cancels all the bonus balls and none of the players want to see the eliminator ball being called as it exits a random ball generator.

In the game of bingo, each player receives a bingo playing card having a matrix of five rows and five columns that define a playing surface of twenty-five grid squares. The word "bingo" is written across the top of each column and each letter in the word identifies a column in consecutive order. Traditional bingo games use the numbers 1 through 75 and the center space of the card is typically marked with the word "free" and is considered an automatically covered bonus spot. The number ranges on the card have been traditionally restricted by column. The "B" column contains numbers between 1 and 15, the "I" column contains number 16 through 30, the "N" column contains numbers 31 through 45, the "G" column contains numbers 46 through 60 and the "O" column contains numbers 61 through 75. A player selects the grid squares as the caller randomly calls the numbered columns. The players can mark the grid squares by daubing or placing items on the squares. A wagering establishment can determine the winner of a bingo game based on specified patterns of called numbers. For example, a player can win by achieving called numbers in a straight line, two straight lines, the entire card or the borders of the grid.

There are many existing methods of playing bingo where the bonus features are initiated when the player obtains a specified event that triggers a bonus during the game. U.S. Pat. No. 8,387,985 to Yuri Itkis, et al. involve a bonus prize being awarded to a player whose bingo playing card has a winning combination of bingo balls called last in a bingo game. This bingo gaming method would not be attractive to most players, as they would have to wait for the completion to achieve the winning combination. The high energy and excitement associated with yelling "BINGO" is also lost and is likely to decrease participation in the game.

U.S. Pat. No. 7,727,786 to Gary Weingardt discloses another method of playing bingo using bonus balls. A player wins bonus prizes based on the color of a plurality of bingo balls. The game has a progressive feature in which each player is eligible for progressive jackpot payouts. This game does not have the excitement of the present invention and is difficult to play. Knowing the basic rules of the game is also necessary for an exciting gaming experience.

Bonus wagering options are attractive to most players, encourage players to wager in a specified game and add to the excitement of a game. Accordingly, there is a need for a bingo game that is exciting to play and will allow for more payouts by the wagering establishment.

The present invention increases a player's chances for bigger payouts by using a bonus wagering and elimination system against the house and each player has the capacity to place an individualized wager against the house. The house can cut the pot and divide the wagers. Multiple levels of bonus awards are offered and an initial wager would determine each player's award. This bingo method features a plurality of bonus and eliminator balls and a reduced number of bingo balls numbered 1-40. The number of bingo balls, maximum spins and numbered spaces on the bingo cards can be increased or decreased depending on the desired speed for the game and the number of players that are present.

The game features a plurality of bonus wagering options including bonus and super bonus wagers. Bonus wagers can be made on a gold ball and additional super bonus balls that are included in a random ball generator. A player can place multiple wagers that these bonus balls will be released during the set maximum spins of the random ball generator. The peer-to-peer wagering allows additional spins and opportunities for the gold and big money balls to be released. A super bonus wager allows wagering on the release of either the gold ball or the big money ball. As the game progresses, a player awaits the release of bonus balls that either double, triple or further multiply a player's winnings The anticipation of bigger payouts continues as the player waits for the big money ball or the gold ball to be released. A player's hopes for a big payout can be eliminated completely if an eliminator ball is released before or after any of the aforementioned bonus balls are called.

The improved bingo game as described herein does not require a large wagering establishment. The game can be played on a bingo-wagering table on a main casino floor or a large room with a caller controlling the game, collecting wagers and signaling the beginning and the ending of the game. At least one player can participate in the game but the wagering establishment can decide to accommodate multiple players or large crowds. This can reduce the advantage taken by the house and produce a fun-filled atmosphere of anticipation as the bonus or eliminator balls are called.

Additionally, the bingo playing card of the present invention contains multiple "free spaces" which speed up the pace of the game and increase a player's chance of winning. The number of free spaces can be increased or decreased depending on the desired length for the game. In the traditional bingo game, individually numbered bingo balls numbered from 1 to 75 are mixed in a number receptacle and are drawn out one at a time. The bingo game and apparatus as described herein provides for numbered bingo balls numbered from 1 to 40. A tracking device is use to hold the bingo balls that have been called. The device has labeled spots for the bingo balls and said bonus balls and has the capacity to record the order of calls.

The game can be administered in a peer-to-peer system where each player places identical wagers and play against a set pool of entry fees. The play continues until a player is deemed a winner and the house can retain a percentage of the pool of entry fees.

To this end there is provided an improved bingo method and apparatus that improves a player's odd of winning, is adapted to provide bonus wagering and bonus elimination system against the house, reduces the number of people needed to play the game, does not require a large wagering establishment and allows peer-to-peer wagering against a set pool of entry fees.

BRIEF SUMMARY OF THE INVENTION

It is therefore an objective of the present invention to address the above concerns and to provide an improved bingo method and apparatus that improves a player's odds of winning by means of a bonus wagering system against the house. The game features multiple levels of bonus awards, a plurality of bonus and eliminator balls and a reduced number of bingo balls.

Another objective of the present invention is to provide an improved bingo method that reduces the number of people needed to play the game. Each player participates in a bonus wagering system against the house and has the capacity to place an individualized wager against the house. At the end of each game, the house can cut the pot and divide the wagers.

Another objective of the present invention is to provide an improved bingo method that does not require a large wagering establishment. The game can be transitioned and immediately set up on the main floor of a wagering establishment or a large wagering room. The bingo game can continue on a comfortable and spacious wagering table having the capacity to seat multiple players.

Another objective of the present invention is to provide an improved bingo method that increases the speed of the game by requiring a maximum of 21 spins with or without a winner. The number of bingo balls, maximum spins and numbered spaces on the bingo cards can be increased or decreased depending on the desired speed for a particular game and the number of players present at the start of the game. The bingo playing card of the present invention contains multiple "free spaces" which increase the pace of the game, the number of free spaces can be increased or decreased depending on the desired length for the game, numbered bingo balls numbered from 1 to 40 are provided and a tracking device is used to hold the bingo balls being called.

Still another objective of the present invention is to allow a peer-to-peer wagering system against a set pool of entry fees. Each player places similar wagers and play against a set pool of entry fees.

Additional advantages and features of the present invention will become more apparent when considered in light of the following specification and drawings.

BRIEF DESCRIPTION OF THE SEVERAL VIEWS OF THE DRAWINGS

FIG. 3 is a representation of a bingo playing card in accordance with the present invention.

FIG. 4 is a representation of a prior art bingo playing card.

FIG. 5 shows the bonus ball designations used to play the bingo game of the present invention.

FIG. 6 shows the wager options as prescribed by the bingo game of the present invention.

FIG. 7 is a bonus payout chart showing the bonus payouts of the present invention.

FIG. 8 is a bingo payout chart showing the bonus payouts of the present invention.

DETAILED DESCRIPTION OF THE INVENTION

Figure 1:
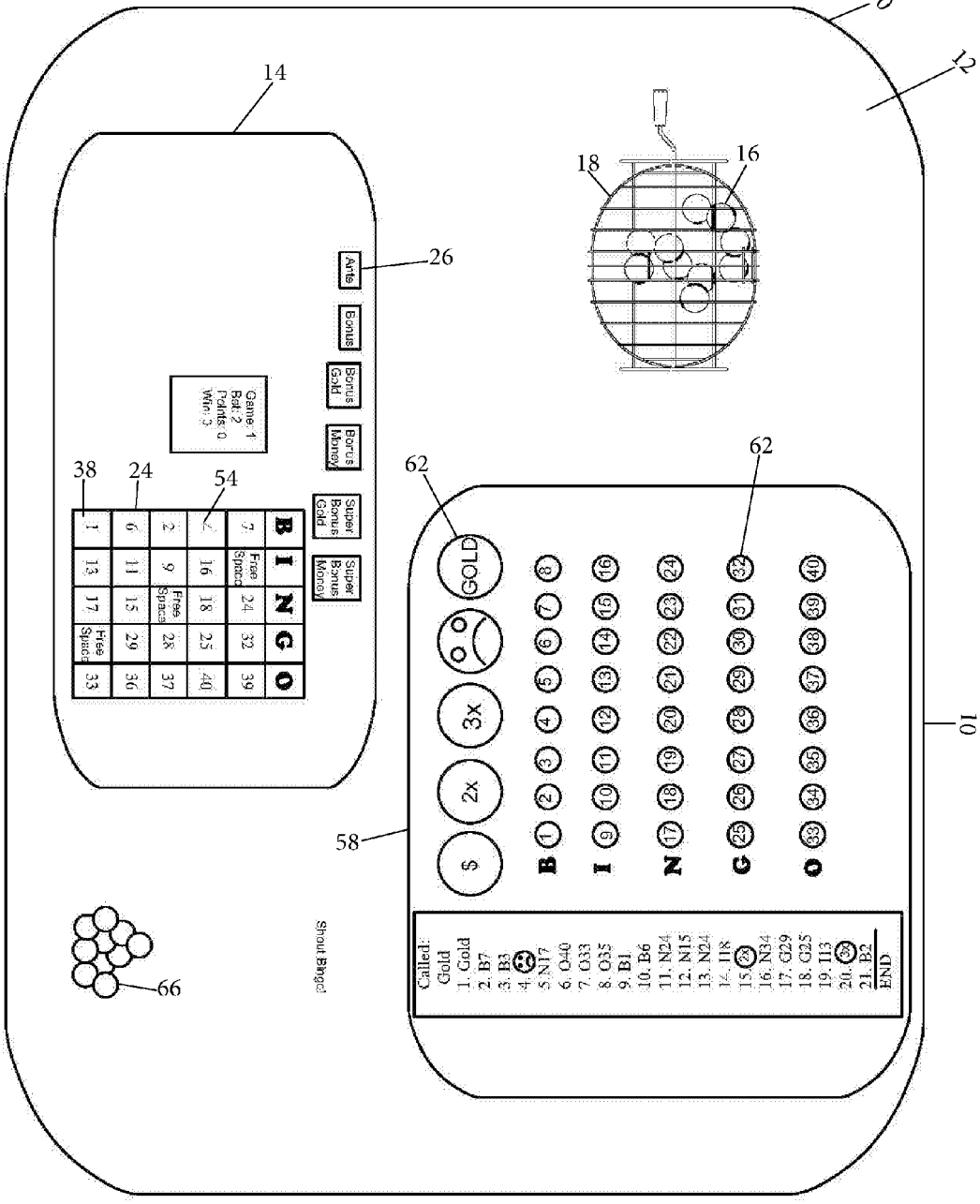
FIG. 1 is a plan view of the bingo-wagering table layout for playing a bingo game according to the present invention.

An improved method of playing a bingo game wherein the bingo game features a plurality of bonus wagering, super bonus wagering and bonus elimination against a wagering establishment. In the spirit of the preferred method of playing the bingo game, FIG. 1 shows a bingo-wagering table 10 being designed to play the bingo game and that can be presented on the main floor of the wagering establishment or a large room. In the beginning of the game, a caller announces the start of the game, the minimum ante wager and the value of the plurality of bonus balls 16. The caller randomly selects the bonus balls 16 from the random ball generator 18 and calls out the number of the bingo balls 16 or the release of bonus balls. The caller further supervises and controls the game including collecting wagers and signaling the ending of a game.

The bingo-wagering table 10 has a playing surface 12 that can accommodate at least one player station 14. The bingo-wagering table 10 preferably includes a random ball generator 18, a plurality of bingo balls 16, a plurality of bonus balls, at least one bingo playing card 24, a plurality of labeled spots for placing ante wagers 26 and a tracking device 58 disposed around the perimeter of the playing surface 12.

Figure 2:
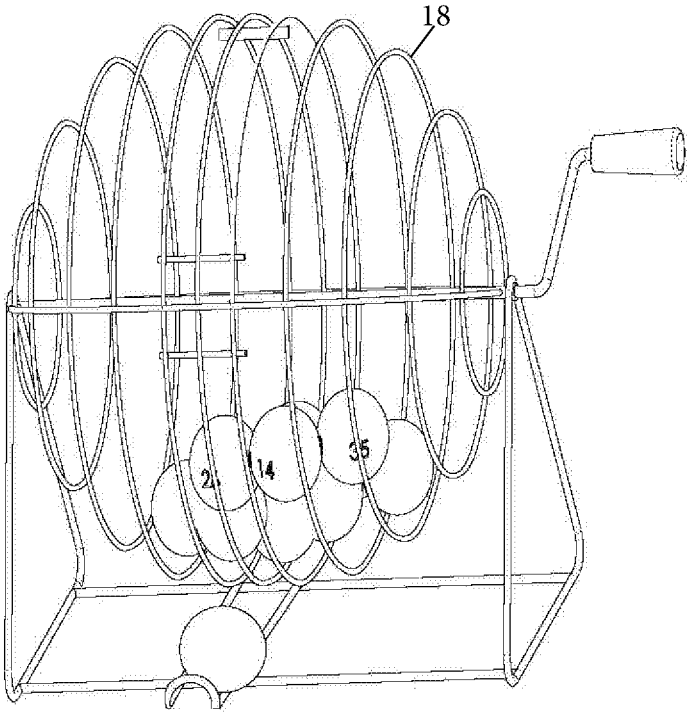
FIG. 2 is a perspective view of a sample random ball generator as described in the present invention.

FIG. 2 shows an exemplary random ball generator 18 that can be located on the bingo-wagering table 10 or in close proximity to the tracking device 58. The random ball generator 18 is sufficiently sized to be placed on the bingo-wagering table 10. As in the traditional bingo game, each bingo ball 16 has a number and word label corresponding to a location on the bingo playing card 24. The wagering establishment can determine the number of bingo balls 16 and bonus balls in the random ball generator 18. The random ball generator 18 includes a plurality of bonus balls that are adapted to affect the value of a player's winnings.

FIG. 5 shows the plurality of bonus ball designations that are placed in the random ball generator 18. The bonus balls consist of at least one eliminator ball 28, at least one gold ball 32, at least one big money ball 34 and a plurality of multiplier balls 36. The eliminator ball 28 cancels the value of the bonus balls if the eliminator ball 28 is called before or after the bonus balls are called. The caller announces the value of the eliminator ball 28 before the game begins. The eliminator ball 28 is displayed with a facial expression 64 or other identifying marks to distinguish it from the additional bonus balls. Other identifying marks can include lines, arrow, dots, colors, pictures or punctuation marks.

As shown in FIG. 6, the game features a plurality of individualized wagering options consisting of an ante wager, bonus wagers and super bonus wagers. The individualized wagers are made against the house and the player making at least one ante wager is a prerequisite to receiving winnings if a player wins the bingo game. If a big money ball 34 is released, it combines the value of any previous bonus balls. The multiplier balls 36 can be designated as 2× or 3× and thereby representing the multiplied value of a player's winnings. Additional distinguishing marks can include words, numbers, colors, logos and drawings. A released gold ball 32 provides for a significant increase of a player's winnings with the wagering establishment setting the value of each gold ball 32.

The bingo playing card 24 of the present invention is indicated in FIG. 3. The game of bingo is well known in the marketplace and a standard bingo playing card 25 is shown in FIG. 4. A standard bingo playing card 25 and the bingo playing card 24 of the present invention include a matrix of five rows and five columns, the rows and said columns defining a grid of twenty-five grid squares 38. A first column labeled B 42, a second column labeled I 44, a third column labeled N 46, a fourth column labeled G 48 and a fifth column labeled O 52 are typically presented.

The modified bingo playing card 24 of the present invention features twenty-five grid squares 38 being numbered from 1 to 40. As in the traditional bingo game, the numbered spots 54 correspond to the numbered bingo balls 16 and the bingo playing card 24 has a plurality of FREE spaces 56. The free space is an automatic bonus spot and adds to the excitement of the game. The grid squares 38 on the first column 42 having the numbers 1 to 8, the grid squares 38 on the second column 44 having the numbers 9 to 16, the grid squares 38 on the third column 46 having the numbers 17 to 24, the grid squares 38 on the fourth column 48 having the numbers 25 to 32, the grid squares 38 on the fifth column 52 having the numbers 33 to 40.

The maximum number of spins and maximum number of numbered spots 54 in each of the bingo games can be modified by the wagering establishment depending on the desired length for each bingo game or the number of players in the game. For example, the wagering establishment can quickly change the maximum number of spins to 28 and announce a new arrangement of grid squares 38 in the following order: B 1-10, I 11-20, N 21-30, G 31-40 and O 41-50.

At least one player is allowed to play and place an individualized ante wager in the bingo game. In addition to the ante wager, a player can make bonus wagers that either a big money ball 34 or the gold ball 32 will be released from the random ball generator 18 and super bonus wagers that either a big money ball 34 or the gold ball 32 is the first ball drawn from the random ball generator 18. The game is played against a wagering establishment that decides the minimum wagers for each game, the value of the bonus balls and the degree of bonus elimination of the eliminator ball 28. As in the traditional game of bingo, the player selects the grid squares 38 which have been called by marking or placing items 66 on the grid squares 38. These items can include coins, chips or other small items that allows the player to track the numbers that have been called. The player achieving a pre-determined pattern of called grid squares 38 is the winner of the game. The wagering establishment distributes awards, bonus prizes and payouts to the winners who the successful bonus wagers. The awards, bonus prizes and payouts can include cash or bonus points.

A caller in the modified bingo game makes a maximum of 21 calls when the bingo game is being played against the house. A tracking device 58 records the number of calls and stores the bingo balls 16 and bonus balls that have been called. The tracking device 58 houses at least 40 receptacles 62 that are arranged in row and column positions for receiving the randomly called bingo balls 16 and the plurality of bonus balls. The receptacles 62 are marked and correspond to the number of bingo balls 16 and bonus balls in the random ball generator. The layout of the tracking device 58 has labeled spots corresponding to the bingo balls 16 and the bonus balls. The order of calls can be recorded and displayed on the tracking device 58.

FIGS. 7-8 show the bonus and bingo payouts as prescribed by the present invention. The payouts set a predetermined winning combination of the gold ball 32, big money ball 34, and bonus balls 36. For example, any player receiving the gold ball 32, the money ball 34 and a bonus ball 36 on the first three spins of the random ball generator receives a payout of 1000 to 1. The player winning the bingo game and having the gold ball 32, the money ball 34 and two of bonus balls 36 receives a payout of 100 to 1. The payout increases to 1000 to 1 if the player wins the bingo game and has the gold ball 32, the big money ball 34 and three bonus balls 36.

The improved method of playing a bingo game described can be played against a common pool where the players wager against each other in a peer-to-peer wagering system. Each player places an identical ante wager against a set pool of entry fees. The wagering establishment cuts the pot and retains a percentage of the entry fees. As in the preferred method of playing this modified bingo format, an actuary of the wagering establishment can determine the value of the bonus balls, winning orders and combinations and the minimum ante wager. The actuary can further determine the odds of winning bonus or super bonus points using spreadsheets, money lines or various other types of sport books.

The bingo game as described herein can be administered in physical, paper, electronic and online game formats. For example, the game can be formatted for active wagering and play on cell phones, laptops and other types of interactive screens.

The description presented and the accompanying drawings are a representation of the modified bingo game and apparatus of the present invention. The bingo game has a speedy installation and convenient set up. The setup can be quickly re-organized to accommodate additional players and large groups.

What is claimed is:

1. An improved method of playing a bingo game wherein said bingo game is played against a wagering establishment, said wagering establishment providing a bingo-wagering table having a playing surface, at least one player station and a caller station, the method comprising:

a caller announcing the start of said bingo game, said caller announcing the value of said plurality of bingo balls, said caller randomly selecting said bingo balls from a random ball generator, said caller calling out said bingo balls to said player, said caller alerting said player of the outcome of said bingo game;

wagering options consisting of an individualized ante wager, bonus wagers and super bonus wagers, said wagering options being made against the house, said player placing said wagers, said wagers being a prerequisite to receiving winnings if said player wins said bingo game;

said bingo-wagering table being designed to play said bingo game, said bingo-wagering table having a random ball generator, a plurality of bingo balls, a plurality of bonus balls, at least one bingo playing card, a plurality of labeled spots for placing said ante wagers, said bonus wagers and said super bonus wagers, at least one of said player station and means for said player to track and cover the called bingo balls, said random ball generator having the capacity to hold and randomly select said plurality of bingo balls, said random ball generator being sufficiently sized to be placed on said bingo-wagering table, said bingo balls being numbered from 1 to 40, said plurality of bingo balls having number and word labels thereon, said number and word labels corresponding to a location on said bingo playing card, said plurality of bonus balls being adapted to affect the value of said player's wager, said plurality of bonus balls consisting of at least one eliminator ball, at least one gold ball, at least one big money ball, and a plurality of multiplier balls, said eliminator ball canceling the value of said bonus balls if said eliminator ball is called before or after said bonus balls are called, said value of said eliminator ball being called at the beginning of the game, said eliminator ball being displayed with a facial expression and other identifying marks to distinguish said eliminator from said bonus balls, said big money ball combining the value of any previous bonus balls obtained, said bingo playing card including a matrix of five rows and five columns, said rows and said columns defining a grid of twenty-five grid squares, said bingo playing card having a first column labeled B, a second column labeled I, a third column labeled N, a fourth column labeled G and a fifth column labeled O, said twenty-five grid squares being numbered from 1 to 40, said numbered spots corresponding to said numbered bingo balls, said bingo playing card having a plurality of FREE spaces designated on said bingo playing card, said grid squares on said first column having the numbers 1 to 8, said grid squares on said second column having the numbers 9 to 16, said grid squares on said third column having the numbers 17 to 24, said grid squares on said fourth column having the numbers 25 to 32, said grid squares on said fifth column having the numbers 33 to 40, said free spaces being randomly placed on said bingo playing cards;

said player wagering on said bingo game, said player placing an individualized wager against said wagering establishment, said player electing said grid squares which have been called by marking or placing items on said grid squares, said player achieving a pre-determined pattern of called grid squares is the winner of the game;

a combined maximum of 21 calls of said bingo balls, said bonus balls and said eliminator ball being made by said caller in said bingo game;

a tracking device, said tracking device having the capacity to retain said bingo balls and said bonus balls that have been called by said caller, said tracking device having at least 40 receptacles arranged in row and column positions for receiving said randomly called bingo balls and said plurality of said bonus balls, said receptacles being marked and corresponding to the number of said bingo balls in said random ball generator, said layout of said tracking device having labeled spots corresponding to said bingo balls and said bonus balls, said tracking device recording the order of calls of said bingo balls, said tracking device displaying the order of calls, said tracking device recording the history of said called bingo balls, said tracking device, said tracking device displaying the order of play and payout during said bingo game, said tracking device displaying the end of said bingo game, said tracking device being placed on said bingo-wagering table, said tracking device being sufficiently close to said caller.

2. The improved method of playing a bingo game as claimed in claim 1 wherein said wagering establishment has the capacity to host a wagering event.

3. The improved method of playing a bingo game as claimed in claim 1 wherein said wagering establishment has the option of receiving a wager.

4. The improved method of playing a bingo game as claimed in claim 1 wherein a bonus wager is a wager that said multiplier ball, said gold ball or said big money ball will be randomly selected from the plurality of bingo balls associated with said bingo game.

5. The improved method of playing a bingo game as claimed in claim 1 wherein a bonus wager is a wager that said gold ball will be drawn from said random ball generator.

6. The improved method of playing a bingo game as claimed in claim 1 wherein a bonus wager is a wager that said big money will be drawn from said random ball generator.

7. The improved method of playing a bingo game as claimed in claim 1 wherein a super bonus wager is a wager that said gold ball is the first ball drawn from said random ball generator.

8. The improved method of playing a bingo game as claimed in claim 1 wherein a super bonus wager is a wager that said big money ball will be the first ball drawn from said random ball generator.

9. The improved method of playing a bingo game as claimed in claim 1 wherein said wagering establishment assigns said individualized wager value for each of said bingo games.

10. The improved method of playing a bingo game as claimed in claim 1 wherein said player having said gold ball on the first spin of said random ball generator receives a payout of 40 to 1.

11. The improved method of playing a bingo game as claimed in claim 1 wherein said player having said gold ball and said big money ball on the second spin of said random ball generator receives a payout of 100 to 1.

12. The improved method of playing a bingo game as claimed in claim 1 wherein said player having said gold ball and said bonus ball on said first two spins of said random ball generator receives a payout of 20 to 1.

13. The improved method of playing a bingo game as claimed in claim 1 wherein said player having said money ball and said bonus ball on said first two spins receives a payout of 20 to 1.

14. The improved method of playing a bingo game as claimed in claim 1 wherein said player having said gold ball, said money ball and said bonus ball on the first three spins of said random ball generator receives a payout of 1000 to 1.

15. The improved method of playing a bingo game as claimed in claim 1 wherein said player winning said bingo game and having said gold ball and said money ball receives a payout of 10 to 1.

16. The improved method of playing a bingo game as claimed in claim 1 wherein said player winning said bingo game and having said gold ball receives a payout of 5 to 1.

17. The improved method of playing a bingo game as claimed in claim 1 wherein said player winning said bingo game and having said money ball receives a payout of 5 to 1.

18. The improved method of playing a bingo game as claimed in claim 1 wherein said player winning said bingo game and having said gold ball, said money ball and one of said bonus ball receives a payout of 20 to 1.

19. The improved method of playing a bingo game as claimed in claim 1 wherein said player winning said bingo game and having said gold ball, said money ball and two of said bonus balls receives a payout of 100 to 1.

20. The improved method of playing a bingo game as claimed in claim 1 wherein said player winning said bingo game and having said gold ball, said money ball and three of said bonus balls receives a payout of 1000 to 1.

21. The improved method of playing a bingo game as claimed in claim 1 wherein said player winning said bingo game and having one of said bonus balls receives a payout of 2 to 1.

22. The improved method of playing a bingo game as claimed in claim 1 wherein said player winning said bingo game and having two of said bonus balls receives a payout of 3 to 1.

23. The improved method of playing a bingo game as claimed in claim 1 wherein said player winning said bingo game and having three of said bonus balls receives a payout of 100 to 1.

24. The improved method of playing a bingo game as claimed in claim 1 wherein said multiplier balls have a distinguishing mark.

25. The improved method of playing a bingo game as claimed in claim 1 wherein the number of free spaces in each of said bingo games is modified by said wagering establishment depending on the desired length for said bingo game as determined by said wagering establishment.

26. The improved method of playing a bingo game as claimed in claim 1 wherein an actuary of a wagering establishment determines the beginning, ending and continuation of said bingo game.

27. The improved method of playing a bingo game as claimed in claim 1 wherein the maximum number of spins in each of said bingo games is modified by said wagering establishment depending on the desired length for said bingo game as determined by said wagering establishment.

28. The improved method of playing a bingo game as claimed in claim 1 wherein the maximum number of said numbered spaces on each of said bingo cards is modified by said wagering establishment depending on the desired length for said bingo game as determined by said wagering establishment.

29. The improved method of playing a bingo game as claimed in claim 1 wherein said bingo game is played against a common pool wherein said players wager against each other, said players placing identical wagers, said players playing against a set pool of entry fees, said house dividing said wagers and retaining a percentage of said set pool of entry fees, said value of said bonus balls and said winning combinations of said bonus balls being determined by an actuary of said wagering.

30. The improved method of playing a bingo game as claimed in claim 1 wherein said bingo game is administered in physical, paper, electronic and online game formats.

* * * * *